US009669429B2

(12) United States Patent
Berger et al.

(10) Patent No.: US 9,669,429 B2
(45) Date of Patent: Jun. 6, 2017

(54) METHOD AND DEVICE FOR TRANSPORTING A NUMBER OF OBJECTS

(75) Inventors: Gisbert Berger, Berlin (DE); Jörg-Andreas Illmaier, Kreuzlingen (CH); Wolf-Stephan Wilke, Constance (DE); Katja Worm, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 1388 days.

(21) Appl. No.: 12/212,675

(22) Filed: Sep. 18, 2008

(65) Prior Publication Data

US 2009/0074557 A1 Mar. 19, 2009

(30) Foreign Application Priority Data

Sep. 18, 2007 (DE) ..... 10 2007 044 733
Jan. 10, 2008 (DE) ..... 10 2008 003 778
Apr. 4, 2008 (DE) ..... 10 2008 017 189

(51) Int. Cl.
*B07C 3/00* (2006.01)

(52) U.S. Cl.
CPC ..... *B07C 3/00* (2013.01)

(58) Field of Classification Search
CPC .... B07C 3/00; B07C 3/08; B07C 3/14; B07C 3/18; B07C 3/082; B07C 3/02; B07C 3/12; B07C 5/00; B07C 5/36; B07C 7/005; B07C 1/02; B07C 3/008; B07C 3/087; B07C 3/20; B07C 7/02
USPC ..... 705/401–411
See application file for complete search history.

(56) References Cited

U.S. PATENT DOCUMENTS

| | | | | |
|---|---|---|---|---|
| 6,703,574 | B1 | 3/2004 | Kechel et al. | |
| 6,888,084 | B1 | 5/2005 | Bayer | |
| 7,482,549 | B2 * | 1/2009 | Madar et al. | 209/584 |
| 7,636,717 | B1 * | 12/2009 | Gupta et al. | |
| 2004/0049315 | A1 | 3/2004 | Sansone et al. | |
| 2005/0269395 | A1 | 12/2005 | Miette et al. | |

(Continued)

FOREIGN PATENT DOCUMENTS

| | | |
|---|---|---|
| DE | 40 00 603 C2 | 7/1991 |
| EP | 0 948 416 B1 | 10/1999 |

(Continued)

OTHER PUBLICATIONS

"Lockheed Martin Selected to Upgrade Sweden's Mail Processing." PR Newswire Oct. 4, 2005: NA. ProQuest. Jan. 31, 2017.*

*Primary Examiner* — Michael Harrington
(74) *Attorney, Agent, or Firm* — Laurence Greenberg; Werner Stemer; Ralph Locher

(57) ABSTRACT

A method and a device for transporting and processing a number of objects, especially mail items, include transporting the objects in a number of transport processes to a respective processing system. At least one processing attribute as well as a feature is measured at the object before the transport processes. A data record with the processing attribute value and the feature value are stored. After the transport processes, the feature is measured again for each object, and the stored data record is determined. A search area restriction which is based on a sequence of feature values is undertaken for the determination. The processing system processes the object depending on the processing attribute value of the determined data record.

7 Claims, 6 Drawing Sheets

(56) References Cited

U.S. PATENT DOCUMENTS

| | | | | |
|---|---|---|---|---|
| 2006/0253406 | A1 | 11/2006 | Caillon | |
| 2007/0215529 | A1* | 9/2007 | Desprez et al. | 209/584 |
| 2008/0149540 | A1 | 6/2008 | Olivier et al. | |

FOREIGN PATENT DOCUMENTS

| | | | |
|---|---|---|---|
| EP | 0948416 | B1 | 10/1999 |
| EP | 1 222 037 | B1 | 7/2002 |
| FR | 2881663 | A1 | 8/2006 |
| WO | 2006/100357 | A1 | 9/2006 |

* cited by examiner

METHOD AND DEVICE FOR TRANSPORTING A NUMBER OF OBJECTS

CROSS-REFERENCE TO RELATED APPLICATION

This application claims the priority, under 35 U.S.C. §119, of German Patent Application DE 10 2007 044 733.9, filed Sep. 18, 2007, German Patent Application DE 10 2008 003 778.8, filed Jan. 10, 2008, and German Patent Application DE 10 2008 017 189.1, filed Apr. 4, 2008; the prior applications are herewith incorporated by reference in their entirety.

BACKGROUND OF THE INVENTION

Field of the Invention

The invention relates to a method and a device for transporting and processing a number of objects, especially mail items.

A mail item typically passes at least twice through a sorting system and is then transported to a respective predetermined delivery address. In the first pass, the delivery address of the mail item is read. In the second pass, the read delivery address is determined again. The mail item is subsequently transported to the determined delivery address.

Traditionally, in the first pass, a code for the destination address is printed on the mail item. That code is read during the second pass. In order to avoid printing codes on mail items, it is proposed in German Patent DE 40 00 603 C2 that a feature vector of the mail item be measured during the first pass and that it be stored together with the read destination address. In the second pass, the mail item is measured again. That produces a further feature vector. That further feature vector is compared with the stored feature vectors to find the stored feature vector of the same object. The destination address, which is stored together with the feature vector which is found, is used as that destination address to which the mail item is to be transported.

A method with the steps of the prior art and a device with the features of the prior art are known from European Patent EP 1 222 037 B1, corresponding to U.S. Pat. No. 6,888,084. The objects there are also mail items, which pass at least once through a sorting machine. The transport device (a container in that case), by which a mail item is transported to the processing system, is determined. The information stored relates to which mail item is being transported in which container. After transport, a machine-readable identification of the container is read. The search for the data record is restricted to the data records of mail items from that container.

A method is known from U.S. Patent Application Publication No. US 2005/0269395 A1 for checking a bar code on a mail item. In a first sorting pass, a unique identification in the form of a bar code is printed on the mail item. In addition, a feature vector for the mail item is created which involves evaluating an image of the mail item. A data record with the feature vector and the identification is stored in a database. The mail item passes through a sorting system a second time. If the system does not succeed in reading the bar code that time, a feature vector is created once more and the mail item is identified with reference to the feature vector.

SUMMARY OF THE INVENTION

It is accordingly an object of the invention to provide a method and a device for transporting and processing a number of objects, which overcomes the hereinafore-mentioned disadvantages of the heretofore-known methods and devices of this general type and which restrict the search area in such a way that it is not required to provide a transport device with a machine-readable identification and to read the identification after the transport device has been transported to the relevant processing system.

With the foregoing and other objects in view there is provided, in accordance with the invention, a method for transporting a plurality of objects. The method comprises:

a. predetermining at least one measurable processing attribute and at least one measurable feature;

b. carrying out a plurality of transport processes;

c. in each transport process:

bringing a plurality of objects in each case in an object order into a transport device;

determining and storing the object order; transporting the transport device along with the objects brought into the transport device to a processing system; and processing the transported objects with the processing system;

a. carrying out the steps for each object to:

measure the value assumed by the processing attribute for the object;

measure a value assumed by the predetermined feature for the object, and create and store a data record for the object;

include the measured feature value and the measured processing attribute value in the data record;

subsequently transport the object by one of the transport processes to a respective processing system;

subsequently measure a value again assuming the feature for the object; determine the stored data record created for the object using the feature value measured in the newly measured feature value; and process the object with the processing system depending on the processing attribute value included in the determined data record;

a. creating a data record order among the data records for the objects transported by the transport process for each transport process, using the stored object order of the transport process;

b. carrying the renewed measurement of the feature values in a measurement order among the objects;

c. selecting a sequence of n objects following each other in the measurement order at least once;

d. creating a sequence of n feature values having an order matching the measurement order, from the n values assumed by the feature for the selected sequence of n objects;

e. determining each sequence of n data records following each other in a stored data record order and in which the order of the n values of the feature matches the created feature value sequence; and f. for each of the n selected objects, searching for the data record stored for that object among the determined data record sequences.

With the objects of the invention in view, there is also provided a device for transporting a plurality of objects. The device comprises: a first processing system;

a second processing system; and a database connected to the first and second processing systems;

a. for executing a plurality of transport processes each including:

bringing a plurality of objects in an order from the first processing system into a transport device in each case;

determining and storing the object order;

transporting the transport device along with the objects brought into the transport device to the second processing system; and processing the transported objects in the second processing system;

a. the first processing system being configured to carry out the following steps for each object:

measuring which value a predetermined processing attribute assumes for the object;

measuring a value assuming a predetermined feature for the object, and creating and storing a data record for the object;

including the measured feature value and the measured processing attribute value in the data record; and subsequently initiating transport of the object through one of the transport processes to a respective processing system;

a. the second processing system being configured to carry out the following steps, for each object:

again measuring a value assuming the feature for the object, after the transport of the object to the second processing system;

using the feature value measured during the renewed measurement, to determine the stored data record created for the object; and processing the object depending on the processing attribute value included by the determined data record;

a. the first processing system being configured for each transport process, using the stored object order of the transport process, to create a data record order among the data records for the objects having been transported by the transport process; and b. the second processing system being configured to carry out the renewed measurement of the feature values in a measurement order including the objects;

c. said second processing system being configured to:

at least once select a sequence of n objects following each other in the measuring order;

create a sequence of n feature values having an order matching the measurement order, from the n values assumed by the feature for the selected sequence of n objects;

determine each sequence of n data records following each other in a stored data record order and having an order of the n values of the feature matching the created feature value sequence; and for each of the n selected objects, search for the data record stored for the object from among the determined data record sequences.

At least one measurable processing attribute and at least one measurable feature are predetermined.

Different objects are transported through a number of transport processes. In each of these transport processes, the following steps are executed:

a. A number of objects in each case are put into a transport device in an object order.

b. This object order is determined and stored.

c. The transport device, along with the objects brought into the transport device, is transported to a processing system.

d. The processing system processes the objects transported to it.

Each object is transported to a respective data processing system. It is possible for all or at least a few of the objects to be transported to the same processing system. The following steps are performed for each object:

a. The value that the processing attribute assumes for the object is measured.

b. The value that the feature assumes for the object is measured.

c. A data record for the object is created and stored. This data record includes the at least one measured feature value and an encoding of the processing attribute value.

d. Subsequently, the object is transported by one of the transport processes to the respective processing system.

e. Then a value that the feature for the object assumes is measured again.

f. Using the feature value measured during the new measurement, the stored data record that was created for the object is determined. In such cases a search area restriction as described below is undertaken.

g. The respective processing system processes the object depending on the processing-attribute value which is included in the determined data record.

The search area restriction includes the following steps:

a. For each transport process a data record order is created in each case in the stored data records. In this case for each transport process, using the stored object order of this transport process, a data record order is created among the data records for those objects which are transported by the transport process.

b. The renewed measurement of the feature values is performed in a measurement order among the objects.

c. At least once a sequence of n objects which follow each other in the measurement order is selected.

d. From the n values which the predetermined feature assumes for the selected sequence of n objects, a sequence of n feature values is created, of which the order matches the measurement order. The order of the n feature values thus matches the order in which these n feature values were measured.

e. Each sequence of n data records is determined which follow each other in a stored data record order and for which the order of the n values of the features (Merk-1) matches the created feature value sequence (v, -, w, z, y).

f. For each of the n selected objects, the data record stored for this object is searched for among the determined data record sequences.

According to the invention, a sequence of feature values is determined. With the aid of this sequence, a search is made for the data record.

The invention removes the need to read a machine-readable identifier or a transport device. It is not necessary for the object order to match the measurement order. Account is thus taken of the possibility of the order of the objects being changed by a transport process.

The invention can be employed, for example, for the processing and sorting of mail items, of items of travelers' luggage or also of containers or other items of freight.

The processing attribute is typically an identification of a destination address to which the object is to be transported. The destination point is, for example, a delivery address for a mail item, or a production line or a factory or a destination station or destination port for an item of luggage or an item of freight.

The processing attribute can also be an identification of an owner of the object, for example, or a dimension or the weight of the object. The processing attribute can also be the result of an evaluation of a delivery fee with which the object is provided.

Other features which are considered as characteristic for the invention are set forth in the appended claims.

Although the invention is illustrated and described herein as embodied in a method and a device for transporting and processing a number of objects, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
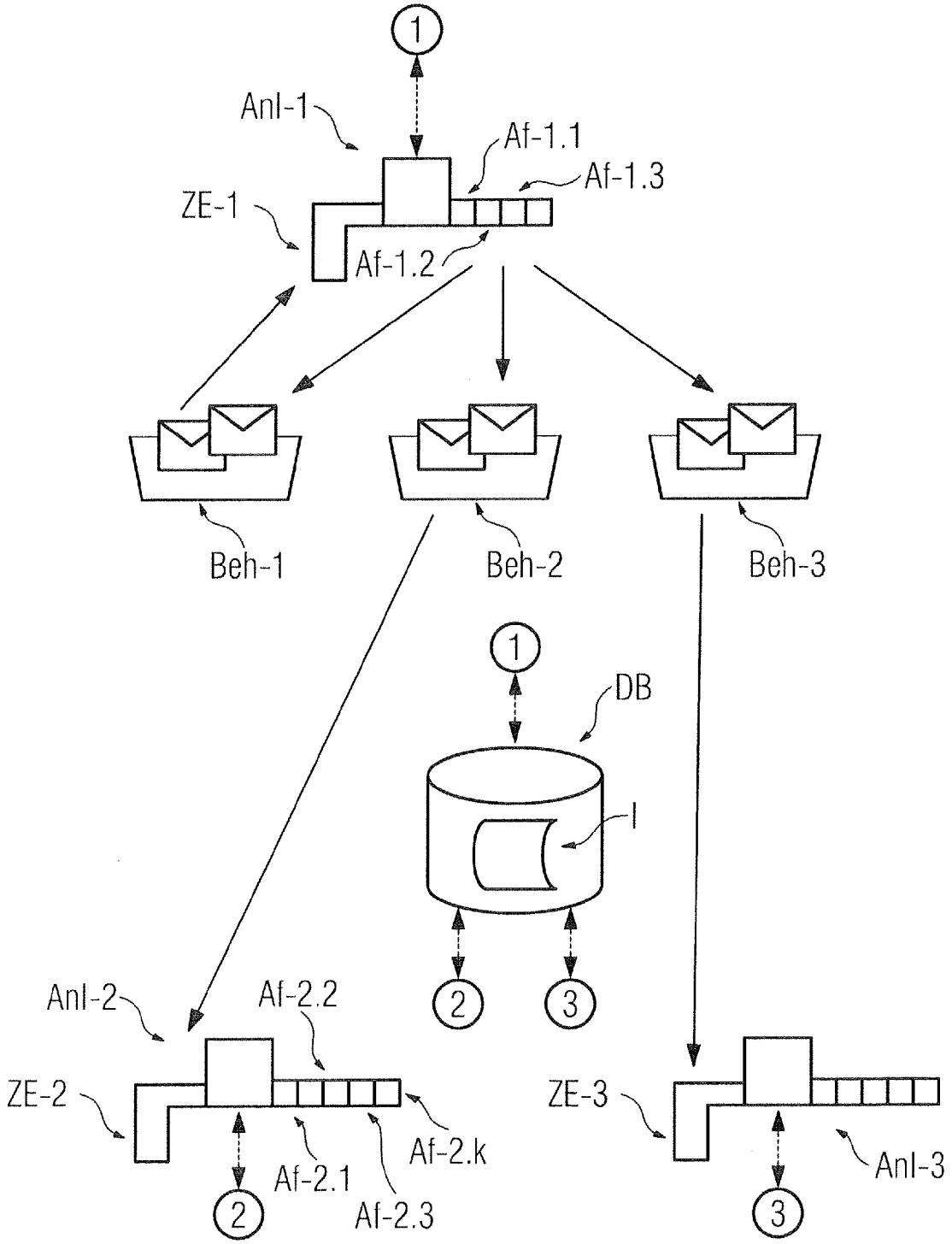
FIG. 1 is a diagram illustrating a network with three processing systems.

Referring now in detail to the figures of the drawings, in which flows of materials are represented by solid lines and flows of data by dashed lines and first, particularly, to FIG. 1 thereof, there is seen a network with three processing systems Anl-1, Anl-2 and Anl-3. These three processing systems are disposed as sorting systems in the exemplary embodiment. Each sorting system features a feed device in the form of a feeder, a read device as well as a plurality of output compartments. Mail items are fed to the feeder of such a sorting system. The feeder separates the mail items. The separated mail items subsequently pass through the sorting system. The read device creates an image of the mail item. The sorting system uses the image to determine the delivery address with which the mail item is provided. This delivery address functions as the processing attribute value of the mail item. The sorting system extracts the mail item, depending on its detected delivery address, into one of the output compartments. Each of the three sorting systems Anl-1, Anl-2, Anl-3 is connected to a central database DB and has read and write access to this database DB.

In the example shown in FIG. 1, mail items are first fed to a feeder ZE-1 of the sorting system Anl-1. The sorting system Anl-1 creates a digital image of each mail item and determines the delivery address. Initially, the sorting system Anl-1 attempts to determine the delivery address automatically by Optical Character Recognition (OCR). If it does not succeed, the image is sent to a video encoding station and an operator manually enters the delivery address—or at least the zip code. Depending on the respective delivery address that is determined, the sorting system Anl-1 extracts the mail item into one of the output compartments.

The example depicted in FIG. 1 shows three output compartments Af-1.1, Af-1.2 and Af-1.3 of the sorting system Anl-1. The mail items which the sorting system Anl-1 has extracted into the output compartment Af-1.1 are brought in the example of FIG. 1 into a container Beh-1. The container Beh-1 with its mail items is again transported to the feeder ZE-1 of the sorting system Anl-1. The mail items from the container Beh-1 are separated by the feeder ZE-1 and pass through the sorting system Anl-1 once again.

Each possible delivery address is assigned a delivery area. All mail items at the same delivery area are extracted in each pass into the same output compartment. It is possible for mail items to different delivery areas to be extracted into the same output compartment. It is possible for a mail item to pass through the same sorting system a number of times, for example because the number of output compartments is smaller than the number of predetermined delivery areas. In this case "n-pass sequencing" is preferably undertaken. Such a method is known from European Patent EP 94 84 16 B1, corresponding to U.S. Pat. No. 6,703,574. After the first pass, the mail items which the sorting system has extracted into an output compartment are brought into a container. The container is transported to the feed device of the second sorting system and the mail items are fed into the sorting system for the second pass.

In the example depicted in FIG. 1, the mail items are fed from the output compartment Af-1.1 of the feed device ZE-1 and pass through the system Anl-1 again. One reason for this can be that an "n-pass sequencing" is being undertaken, as just described. It is also possible for individual mail items to pass through the sorting system Anl-1 a number of times since an "off-line video coding" was performed. In the first pass a digital image of the mail item is created. The attempt to recognize the address in this image is not successful, so that the image is transported to a video encoding station. There the address is entered manually. After this has been done, the mail item once again passes through the sorting system and is extracted, depending on the address, into an output compartment. It is also possible for mail items to be dispatched within a local or delivery area and for the first sorting system Anl-1 for these mail items to thus undertake both the input sorting and also the subsequent exit sorting.

The mail items that the sorting system Anl-1 has extracted into the output compartment Af-1.2 are brought in the example depicted in FIG. 1 into a container Beh-2. The container Beh-2 with these mail items is transported to the feeder ZE-2 of the second sorting system Anl-2. The mail items from the container Beh-2 are separated by the feeder ZE-2 and pass through the sorting system Anl-2. The same occurs with the mail items that the first sorting system Anl-1 has extracted into the output compartment Af-1.3. These are transported in a container Beh-3 to the feeder ZE-3 of the third sorting system Anl-3.

The other two sorting systems Anl-2 and Anl-3 once more use the read result which the sorting system Anl-1 has obtained. In order to make this possible, the sorting system Anl-1 creates a data record for each mail item which passes through the sorting system Anl-1 and stores it in the central database DB as part of transport information I. This data record includes:

a. an internal identifier of the mail item, as well as
b. an identifier for the delivery address that the first sorting system Anl-1 has read.

Each further sorting system through which the mail item passes detects this mail item again. Thus, a number of features which can be measured optically are predetermined. Examples of such features are:

a. The dimensions of the mail item,
b. The distribution of gray values and/or color tones on a surface of the mail item,
c. The position and dimensions of the franking mark, d. The position and size of the address block and/or the sender's details, as well as e. The features of the delivery address, e.g. the zip code.

For each mail item that passes through the sorting system Anl-1, the first sorting system Anl-1 determines the value which each predetermined feature assumes for this mail item in each case. This means that the first sorting system Anl-1 creates a feature vector (more precisely a feature value vector), which for n predetermined features is formed of n feature values. The data record for the postal item is supplemented by the first sorting system Anl-1 by the feature vector, i.e. by an identification of the n feature values.

The second sorting system Anl-2 likewise measures the respective value which each predetermined feature assumes for this mail item, for each mail item that passes through the sorting system Anl-2. In this way, the second sorting system Anl-2 likewise creates a feature vector with n feature values. The second sorting system Anl-2 carries out a read access on the central database DB. The feature vectors of stored data records are compared with the current measured feature vector. In this way, that data record is determined which originates from the current mail item to be examined. This data record includes the delivery address of the mail item that the first sorting system Anl-1 has read.

Figure 2:
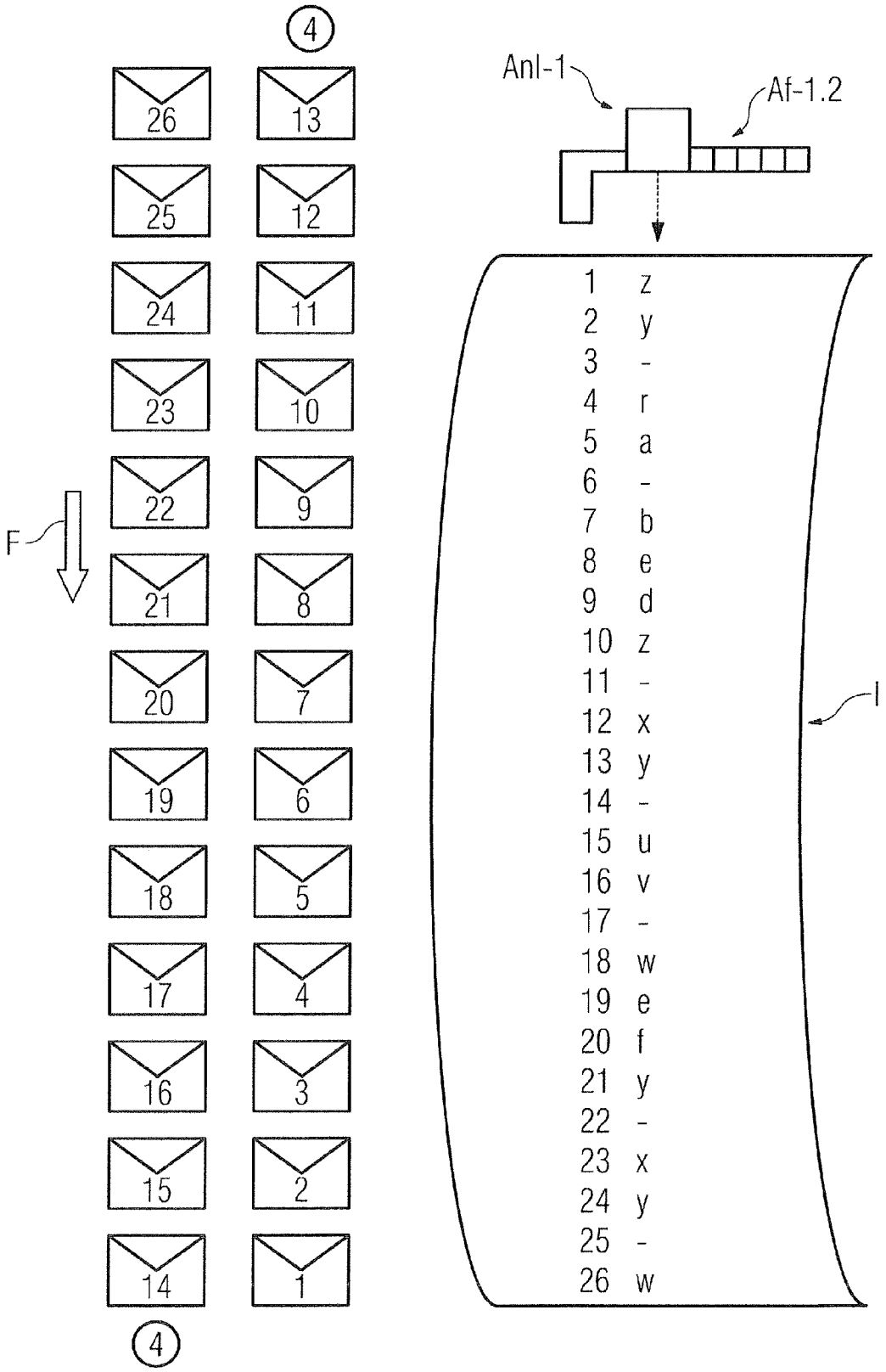
FIG. 2 is a diagram illustrating a sequence of 26 mail items which pass through a first sorting system and are extracted in an extraction order.

FIG. 2 shows a sequence of 26 mail items that has passed through the first sorting system Anl-1 and has been extracted into the output compartment Af-1.2 in an extraction order. After the extraction, the mail item 1 is located as the first mail item in the output compartment Af-1.2, followed by the mail item 2, then the mail item 3 and so forth. In FIG. 2, the sequence is divided up into two columns. The direction of conveyance upon extraction is indicated by an arrow F.

The first sorting system Anl-1 measures the values of a number of features for each mail item, including the value that an identifying feature Merk-1 can assume. For each mail item this feature Merk-1 assumes precisely one of the following values: a, b, c, d, e, f, r, u, v, w, x, y, z, -. A data record is stored in the transport information I in the central database DB for each mail item. This data record includes an internal identifier of the mail item as well as the value that the feature Merk-1 assumes for this mail item. FIG. 2 shows the value that the first sorting system Anl-1 has measured for each of the 26 mail items and has stored as part of the transport information I. For example, the first sorting system Anl-1 has measured and stored the fact that the feature Merk-1 assumes the value y for the mail item 13.

Mail items are regularly taken out of the output compartment Af-1.2, put into a container and transported in this container to the feeder ZE-2 of the second sorting system Anl-2. The container Beh-2 is shown as an example in FIG. 1. The 26 mail items are transported in a single transport process through the use of the container Beh-2 to the feeder ZE-2. FIG. 2 shows the extraction order which functions as the object order among the 26 mail items, as well as the corresponding data record order among the 26 data records for these 26 mail items.

Figure 3:
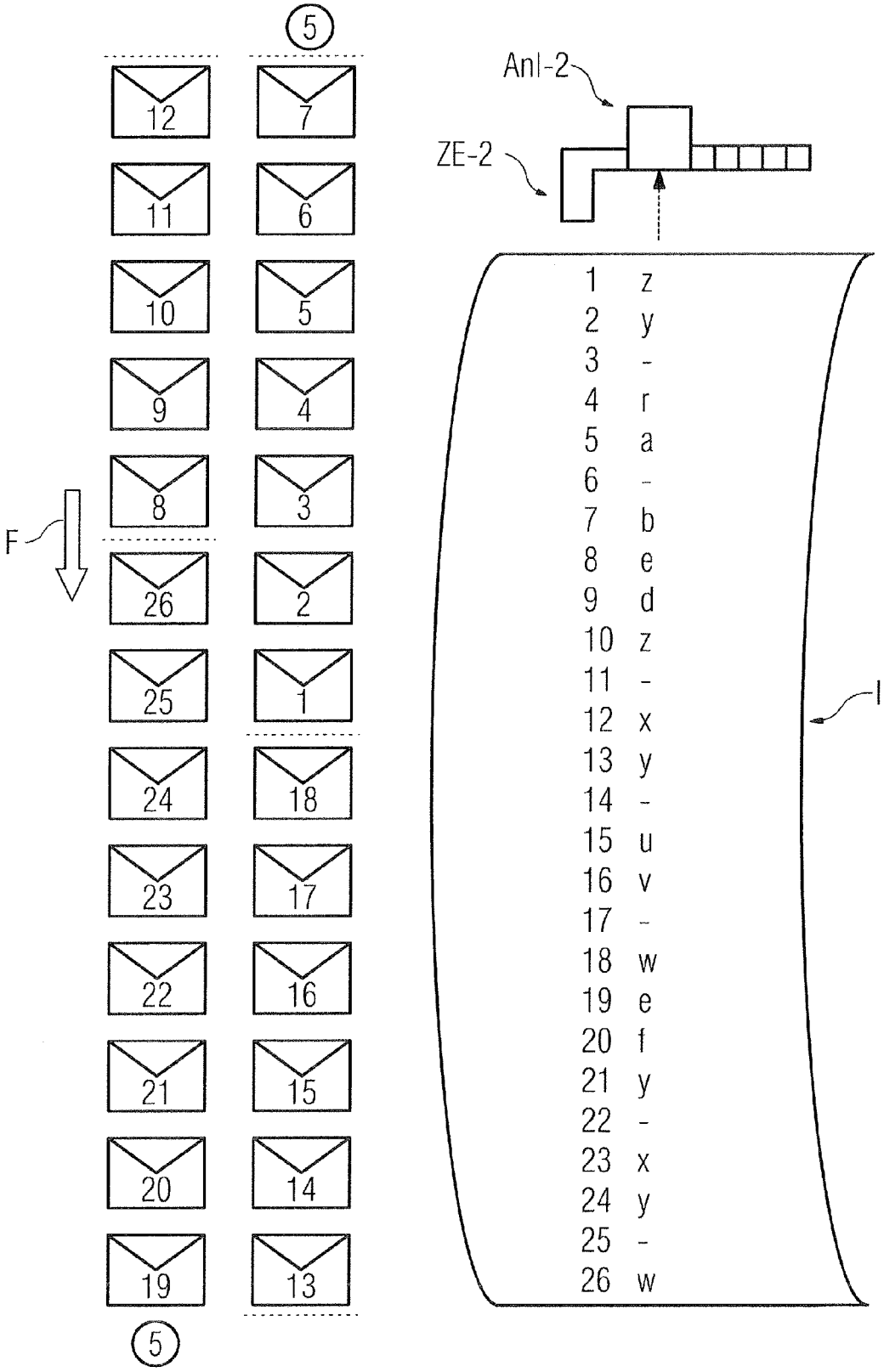
FIG. 3 is a diagram illustrating a feed order in which the 26 mail items are fed from a feed device of FIG. 2 to a second sorting system.

The order which the first sorting system Anl-1 has established upon extraction is not completely adhered to during the transport process. Instead, the order is only adhered to in partial sequences and in this way a feed order is created which deviates from the extraction order. The 26 mail items are fed to the feeder ZE-2 of the second sorting system Anl-2 in this feed order. This feed order with the partial sequences is illustrated by FIG. 3. The boundaries between the partial sequences are indicated by dashed lines in FIG. 3. These boundaries are, however, not physically identified, e.g. by separator cards. The second sorting system Anl-2 cannot exclusively reconstruct the extraction order from the feed order.

In the exemplary embodiment, a maximum number n_max of selected objects is predetermined. The method is first explained with reference to FIG. 4 for the mail item 13, which is the first to reach the feeder ZE-2. A sequence of n_max=5 consecutive mail items is selected. In the example shown in FIG. 4 these are mail items 13 to 17. The second sorting system Anl-2 does not, however, "know" which mail items these are. Thus the n_max=5 mail items in FIG. 5 are labeled x1 to x5.

Figure 4:
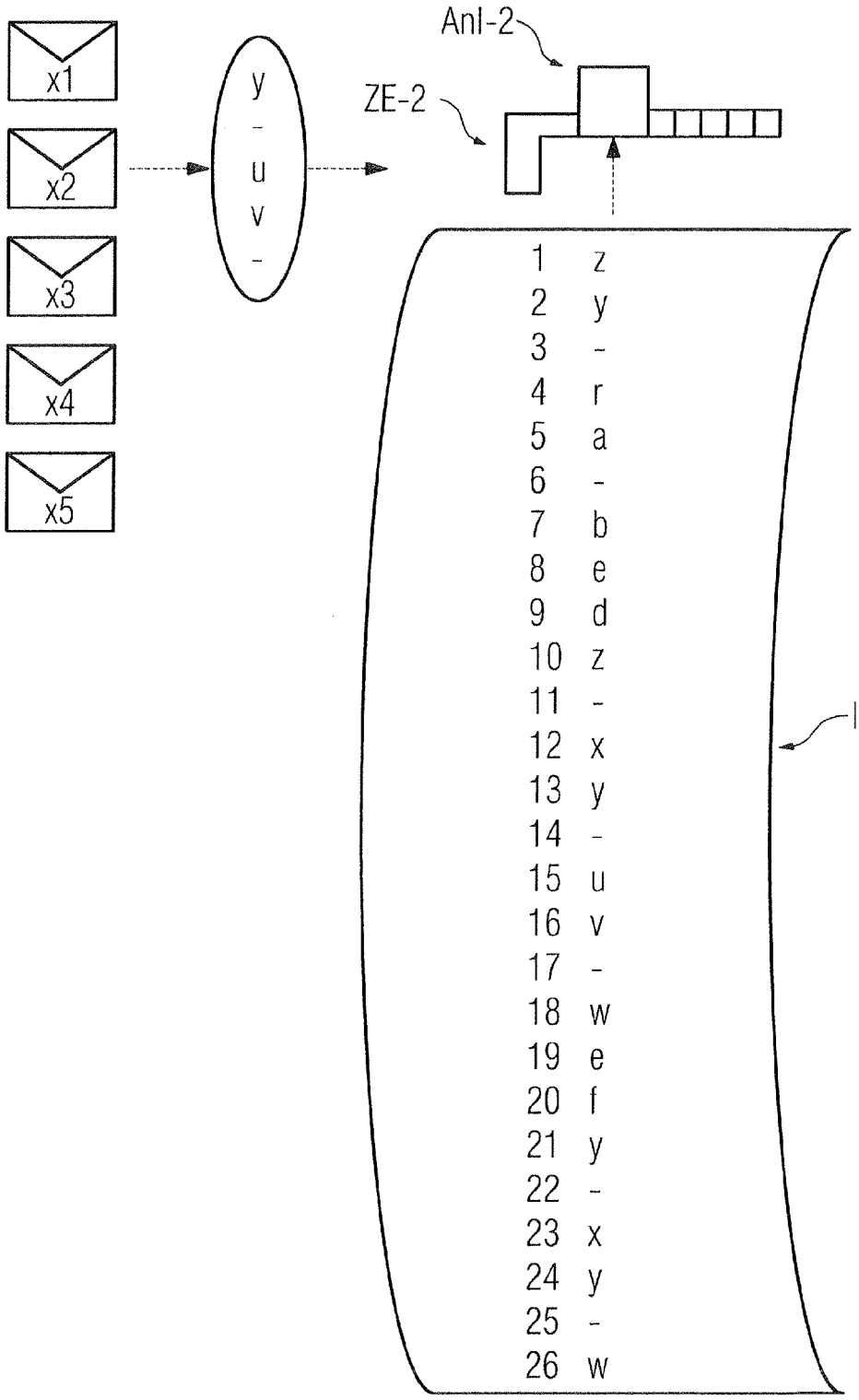
FIG. 4 is a diagram illustrating a search for a sequence of n data records for a mail item 13.

The second sorting system Anl-2 measures the value of the identified feature Merk-1 for the five mail items x1 to x5. In this way it creates a feature value sequence with n=n_max=5 feature values, namely the sequence y, -, u, v, -. This sequence is compared with the stored data record sequences in the transport information I. FIG. 4 typically shows a data record sequence, namely that for the 26 mail items which were jointly transported in the container Beh-2. In this data record sequence there is only one partial sequence of n=n-max=5 data records, for which the feature value sequence y, -, u, v, - occurs, namely the partial sequence with the data records for the mail items 13 to 17. Using the other feature values, a check is made as to whether or not these five data records actually originate from the five mail items 13 to 17.

Figure 5:
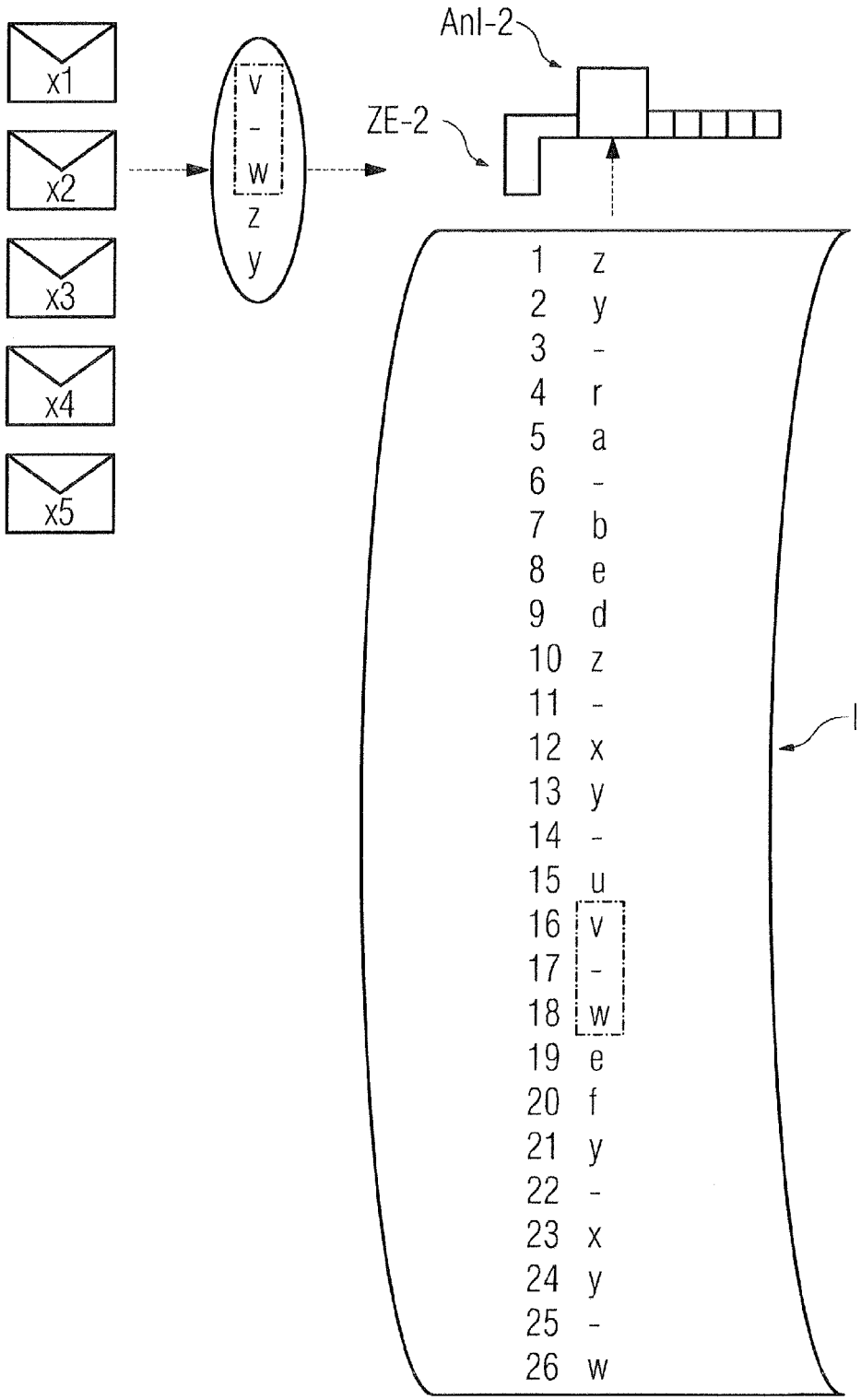
FIG. 5 is a diagram illustrating a search for a sequence of n data records for a mail item 16.

FIG. 5 illustrates the method for the mail item 16. The object sequence is formed of the mail items 16, 17, 18, 1, 2. This time the n=n_max=5 feature values v, -, w, z, y are measured as the feature value sequence. The sequence is compared to the data record order. In this case no data record sequence with n=n_max=5 is found in which the feature value sequence v, -, w, z, y occurs.

Thus, n is reduced by 1, i.e. n=4. The object sequence is formed of the mail items 16, 17, 18, 1. Only the n=4 feature values of the mail items x1, x2, x3 and x4 are used. This delivers the feature value sequence v, -, w, z. However, no data record sequence with n=4 data records is found in the transport information I either, in which the feature value sequence v, -, w, z occurs.

Once more n is reduced by 1, i.e. n=3. Only the n=3 feature values of the mail items x1, x2 and x3 are used. This delivers the feature value sequence v, -, w. A single data record sequence with n=3 data records is found, in which the feature value sequence v, -, w occurs, namely the data record sequence of the n=3 mail items 16, 17, 18. This is indicated in FIG. 5 by two rectangles. Using the values of the further features, a check is made as to whether or not the data records of the mail items 16, 17, 18 actually originate from the mail items x1, x2 and x3.

The check as to whether or not the found data record sequence actually originates from the selected object sequence is conducted by using the measured values of the remaining features—the measured feature values are compared to the feature values of the data records. It is possible for it to be established in this case that the found data record sequence does not originate from the objects of the selected object sequence. n is also reduced in this case in order to find further data record sequences among which the then correct data record sequence is can be found.

Figure 6:
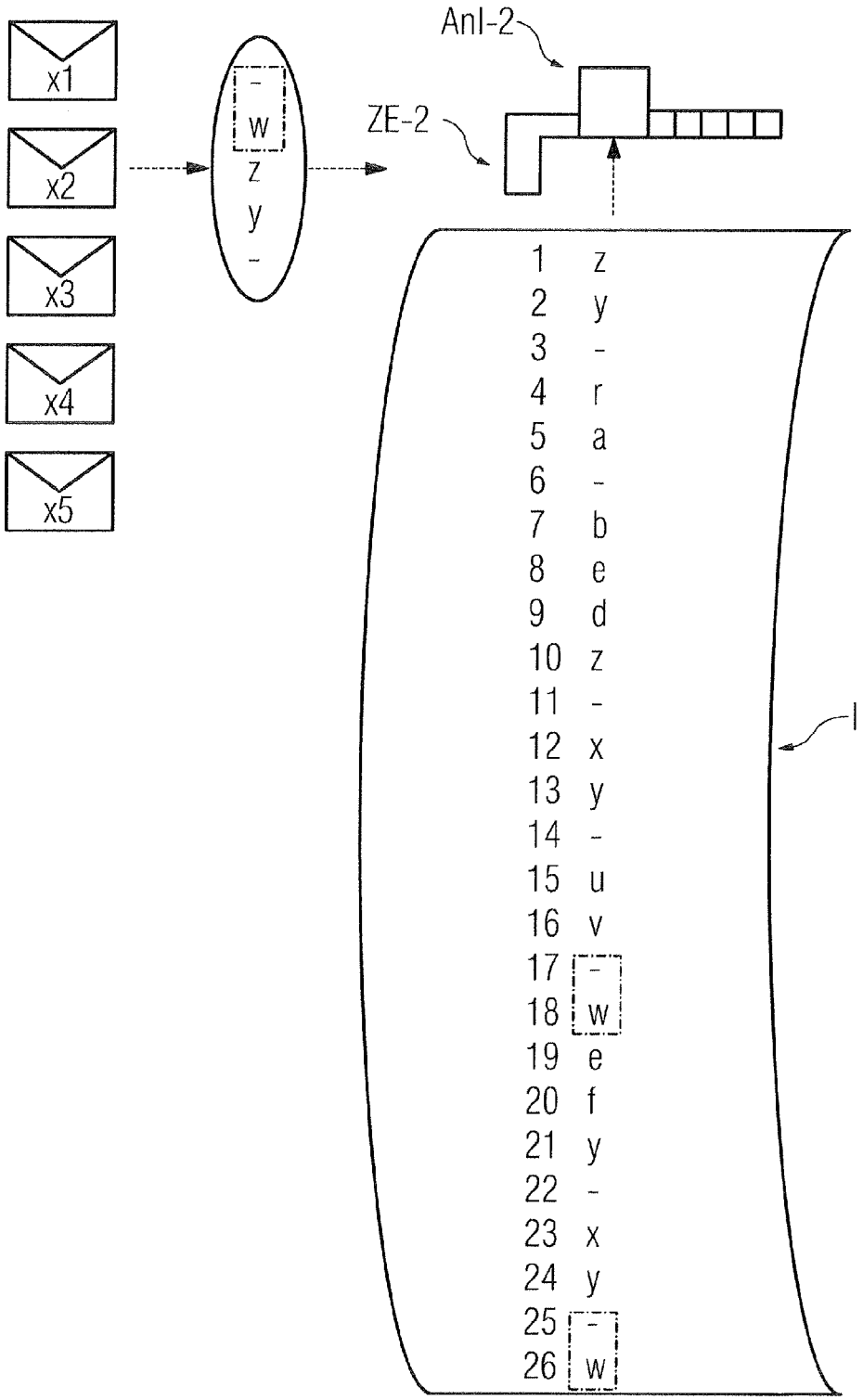
FIG. 6 is a diagram illustrating a search for a sequence of n data records for a mail item 17.

FIG. 6 illustrates the method for the case of the mail item 17. In this example n is reduced until such time as n=2. The feature value sequence is -, w. Two data record sequences are found, namely 17, 18 as well as 25, 26. The values of the further features are used to test whether or not the mail items x1, x2 are identical with the mail item 18 or identical with the mail item 26.

The invention claimed is:

1. A method for processing a plurality of objects comprising the steps of:

feeding a plurality of objects to a first processing device, and processing the plurality of objects by the first processing device, wherein the first processing device performs the following steps during the processing:

measuring a value of at least one predetermined, measurable processing attribute for each object of the plurality of objects, measuring a value of at least one predetermined, measurable feature for each object of the plurality of objects, creating and storing a data record for each object of the plurality of objects, the data record for each object including the measured value of the at least one predetermined, measurable feature and the measured value of the at least one predetermined, measurable processing attribute for the respective object, and storing the data records for the plurality of objects in a database in an extraction order;

transporting at least a subset of the plurality of objects to the second processing device;

feeding, at least a subset of the plurality of objects to a second processing device in a measurement order, and processing the at least a subset of the plurality of objects with the second processing device, wherein the second processing device performs the following steps during the processing:

selecting a number n of objects following each other in the measurement order, measuring a value of the predetermined, measurable feature for each of the n objects following each other within the subset of the plurality of objects, creating a sequence of the measured n feature values, the n measured values in the feature sequence having an order matching the measurement order, and comparing the sequence of the measured n feature values with the data records stored in the database in the extraction order for identifying a partial sequence of n data records with their feature values in the extraction order matching the measured n feature values in the feature sequence for determining the stored data records that originate from the n objects following each other, wherein the partial sequence of n data records has no physically identifiable boundaries; and processing each of the selected n objects in dependence upon the measured value of the at least one predetermined, measurable processing attribute included in the determined stored data records.

2. The method according to claim 1, further including the steps of:

predetermining a maximum number n_max of objects to be selected in the selecting step, wherein n_max >=2;

using n=n_max in the creating and comparing steps performed in the second processing device; and if no order of n=n_max matching data records is found, performing the creating step, determining each sequence step and searching step again with a smaller number n<n_max of selected objects.

3. The method according to claim 2, further including the step of:

performing the creating and comparing steps performed by the second processing device again, with an even smaller number n<n_max of selected objects; and repeating the creating and comparing steps performed in the second processing device with a reduced number of objects to be selected until an order of matching data records is found or an abort criterion is fulfilled.

4. The method according to claim 1, which further comprises, for each object:

measuring a value for at least a second predetermined feature of the object in the first transport process and taking a further measurement value for the at least a second predetermined feature in the at least one subsequent transport process;

storing at least the measured value for the at least a second predetermined feature in the data record for the object by the first measured feature value; and for each data record sequence found using the n values of the further measurement for the at least a second predetermined feature for the n selected objects:

checking if the n data records of the data record sequence were created for the n objects of the selected object sequence or at least one of the n data records for another object; and then, if a data record sequence is found having n data records originating from the n objects of the selected object sequence, using the n data records of the found data record sequence as the data records determined for the n objects of the selected object sequence.

5. The method according to claim 1, wherein:

the at least one predetermined, measurable processing attribute value is an indicator of a destination point to which the object is to be transported and with which the object is provided; and delivering each of the selected n objects in dependence upon the measured value of the at least one predetermined, measurable processing attribute included in the determined stored data record.

6. A system for processing objects, comprising:

a first processing device, a second processing device, a sorter, a transport device, and a database;

the first processing device for processing a plurality of objects fed to the first processing device, said first processing device configured to:

measure a value of at least one predetermined, measurable processing attribute and of at least one predetermined, measurable feature for each object of said plurality of objects, create and store in the database a data record for each object of said plurality of objects, the data record for each object including the measured value of the at least one predetermined, measurable feature and the measured value of the at least one predetermined, measurable processing attribute for a respective object, and store the data records for said plurality of objects in an extraction order;

the sorter configured to extract said plurality of objects in said extraction order from said first processing device;

the transport device configured to transport at least a subset of said plurality of objects to a second processing device;

the second processing device for processing the subset of said plurality of objects fed to said second processing device in a measurement order, said second processing device configured to:

select a number n of objects following each other within said subset of said plurality of objects fed in said measurement order, measure a value of the predetermined, measurable feature for each of the n objects following each other within said subset, create a sequence of the measured n feature values, the n measured values in the feature sequence having an order matching said measurement order, compare said sequence of the measured n feature values with the data records stored in said extraction order for identifying a partial sequence of n data records with their feature values in said extraction order matching the measured n feature values in said feature sequence for determining stored data records that originate from the n objects following each other, and process each of the selected n objects in dependence upon the measured value of the at least one predetermined, measurable processing attribute included in the determined stored data records, wherein the partial sequence of n data records has no physically identifiable boundaries in the database.

7. The device according to claim 6, wherein said second processing system further includes a data memory storing a maximum number n_max of selected objects, wherein n_max >=2, said second processing system configured to:

carry out the search of the stored data records for a maximum number of selected objects; and if it has not found any sequence of n=n_max matching data records, to create and compare said feature sequence with said data records once again with a smaller number n<n_max selected objects.

* * * * *